US007360757B2

(12) United States Patent
Parker et al.

(10) Patent No.: US 7,360,757 B2
(45) Date of Patent: Apr. 22, 2008

(54) STACK CONDITIONING APPARATUS AND METHOD FOR USE IN BOOKBINDING

(75) Inventors: Kevin P. Parker, Berkeley, CA (US); Harold P. Hocking, Manhattan Beach, CA (US); Eugene E. Anderson, Berkeley, CA (US)

(73) Assignee: Powis Parker Inc., Berkeley, CA (US)

( * ) Notice: Subject to any disclaimer, the term of this patent is extended or adjusted under 35 U.S.C. 154(b) by 0 days.

(21) Appl. No.: 10/775,039

(22) Filed: Feb. 9, 2004

(65) Prior Publication Data

US 2005/0173856 A1 Aug. 11, 2005

(51) Int. Cl.
*B42C 11/00* (2006.01)

(52) U.S. Cl. ..... 270/58.07; 412/16; 83/917

(58) Field of Classification Search ..... 270/58.07, 270/52.17; 412/16; 83/917
See application file for complete search history.

(56) References Cited

U.S. PATENT DOCUMENTS 1,642,866 A * 9/1927 Ackley ..... 144/136.1
2,646,726 A * 7/1953 Fogg ..... 409/185
4,182,186 A * 1/1980 Hirsch ..... 83/468.8
4,717,236 A * 1/1988 Dewing ..... 385/109
5,383,755 A * 1/1995 Hassig et al. ..... 412/16
5,961,268 A 10/1999 Jager ..... 412/1
6,012,890 A 1/2000 Celorio Garrido ..... 412/19
6,213,703 B1 4/2001 Celorio Garrido ..... 412/19

OTHER PUBLICATIONS

InstaBook, *"Book on Demand Binding"*, 1 page, downloaded from the Internet on Feb. 10, 2004 from http://www.instabook.net/binding.html.

* cited by examiner

*Primary Examiner*—Khoi H. Tran
*Assistant Examiner*—Leslie A. Nicholson, III
(74) *Attorney, Agent, or Firm*—Girard & Equitz LLP

(57) ABSTRACT

Apparatus for conditioning an edge of a stack of sheets to be bound so that sheets having coated surfaces and the like can be reliably bound. The apparatus includes a stack clamping mechanism configured to secure the stack of sheets and a piercing member configured to produce a piercing action substantially in a piercing plane. Also provided is a positioning mechanism configured to control relative movement of the stack clamping mechanism and the piercing mechanism so that the sheets of the stack pass through the piercing plane, with the drive mechanism being configured to drive the piercing member into the edge of the stack at least once for each sheet of the stack passing through the piercing plane.

59 Claims, 13 Drawing Sheets

STACK CONDITIONING APPARATUS AND METHOD FOR USE IN BOOKBINDING

BACKGROUND OF THE INVENTION

1. Field of the Invention

The present invention relates generally to the field of bookbinding and in particular to apparatus for preparing a stack of sheets to be bound for binding.

2. Description of Related Art

Bookbinding apparatus have been developed which permits stacks of sheets to be bound using thermally activated adhesive binder strips. Such binder strips are typically applied using relatively low cost desktop binding machines such as disclosed in U.S. Pat. No. 5,052,873, the contents of which are also incorporated herewith by reference. Referring to the drawings, FIG. 1 shows a binder strip 20 disposed adjacent the insertion point 30A of a conventional binding machine 30. A user first inserts a stack of sheets 32 to be bound in an upper opening of the machine. Controls 30B are then activated to commence the binding process. The binding machine operates to sense the thickness of the stack 32 and indicates on a machine display 30C the width of binder strip 20 to be used. Typically, three widths can be used, including wide, medium and narrow. The binder strip includes a flexible substrate 20A having a length that corresponds to the length of the edge of the stack 32 to be bound and a width somewhat greater than the thickness of the stack. A layer of heat-activated adhesive is formed on one side of the substrate, including a low viscosity, low tack central adhesive band 20C and a pair of high viscosity, high tack outer adhesive bands 20B.

Once the user has selected the binder strip of appropriate width, the user manually inserts the strip 20 into the strip loading port 30A of the machine. The end of the strip, which is positioned with the adhesive side up, is sensed by the machine and is drawing into the machine using an internal strip handling mechanism. The machine then operates to apply the strip to the edge of the stack to be bound. The strip is essentially folded around the edge of the stack, with heat and pressure being applied so as to activate the adhesives. Once the adhesives have cooled to some extent, the bound book is removed from the binding machine so that additional books can be bound. FIG. 2 depicts a partial end view of the bound stack 32. As can be seen, the substrate 20A is folded around the bound edge of the stack. The high tack, high viscosity outer adhesive bands 20B function to secure the strip to the front and back sheets of the stack. These sheets function as the front and rear covers and can be made of heavy paper or the like. The central, low viscosity adhesive 20C functions to secure the individual sheets of the stack by flowing up slightly between the sheets during the binding process.

Although the above-described binding technique provides a reliable bind in most applications, problems arise when the sheets of the stack have special coatings. Such coatings are applied to the sheets for various purposes to enhance the characteristics of the sheet, such as improving the ability of the sheet to receive special printing inks. In any event, such coatings very frequently prevent the central adhesive 20C from adhering adequately to the individual sheets of the stack. This results in an unsatisfactory bind where sheets frequently separate from the stack. Various approaches have been used to address this problem. One approach is to use different types of adhesive for the central adhesive 20C. Another approach is to texturize the stack of sheets prior to binding so that the adhesive is more likely to accept the central adhesive. By way of example, in U.S. Pat. No. 5,961,268 entitled "Method and Device for Adhesive Binding of Printed Products", a rotating wire brush is applied to the edge of a stack of sheets prior to binding. This approach has not been found satisfactory in addressing the problems relating to coated papers. As a further example, prior art binding systems commonly referred to as perfect binding incorporate milling apparatus that grinds or mills the edge of a stack to be bound. However, stacks of coated sheets processed in this manner cannot be reliably bound using most thermal activated adhesives. Further, such milling results in the production of debris that must be removed and disposed of during the subsequent binding process.

There is a need for an apparatus for conditioning a stack of sheets, prior to binding, that will permit the stack to be reliably bound using conventional thermal adhesive binder strips as previously described. As will be apparent to those skilled in the art upon a reading of the following Detailed Description of the Invention together with the drawings, the present invention meets these and other requirements. Once a stack of coated sheets has been conditioned in accordance with the present invention, a reliable bind can be achieved using conventional relatively low cost desktop binding equipment and binder strips.

SUMMARY OF THE INVENTION

Apparatus and method for conditioning an edge of a stack of sheets to be bound are disclosed. Such apparatus and method allow the adhesives used in conventional thermal binder strips to adhere to the individual sheets of the stack even when the sheets are coated. A stack clamping mechanism is included to secure the stack during the conditioning process. A piercing member operates to produce a piercing substantially in a piercing plane. A ceramic blade is an exemplary piercing member. A positioning mechanism is used to control a relative movement of the stamp clamping mechanism and the piercing member. In one exemplary embodiment, the positioning mechanism moves the stack over the piercing member. The positioning mechanism functions to position the sheets as the stack move through the piercing plane. A drive mechanism operates to drive the piercing member into the edge of the stack at least once, and preferably more, for each sheet of the stack passing through the piercing plane. This piercing action functions to form relatively large areas of exposed fibrous materials of the inner region of the sheets thereby permitting the binder strip adhesive to adhere to the individual sheets even when coatings are present.

DETAILED DESCRIPTION OF THE INVENTION

Figure 3:
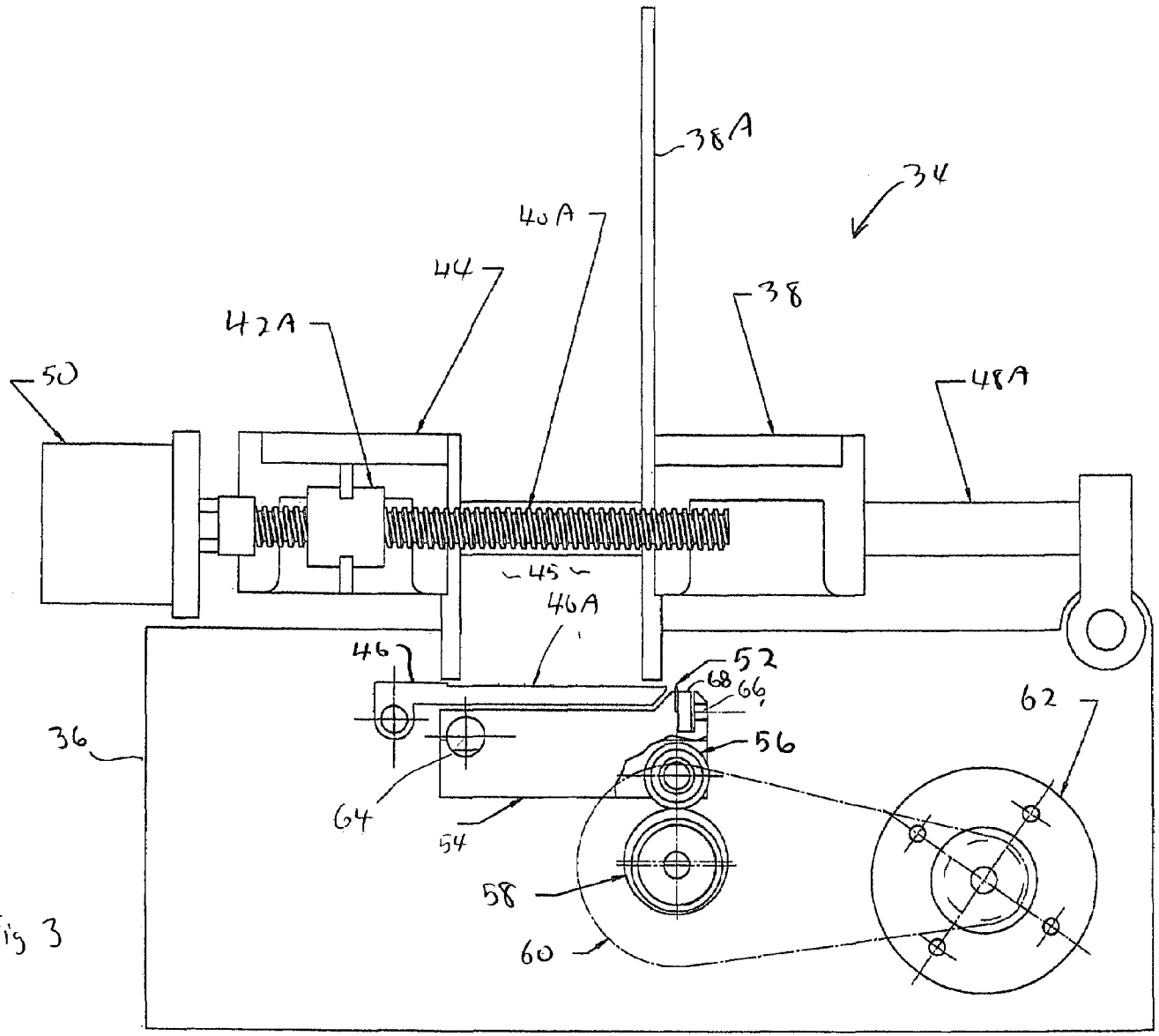
FIG. 3 is a side elevational view of a stack conditioning apparatus in accordance with an exemplary embodiment of the present invention.
Figure 4:
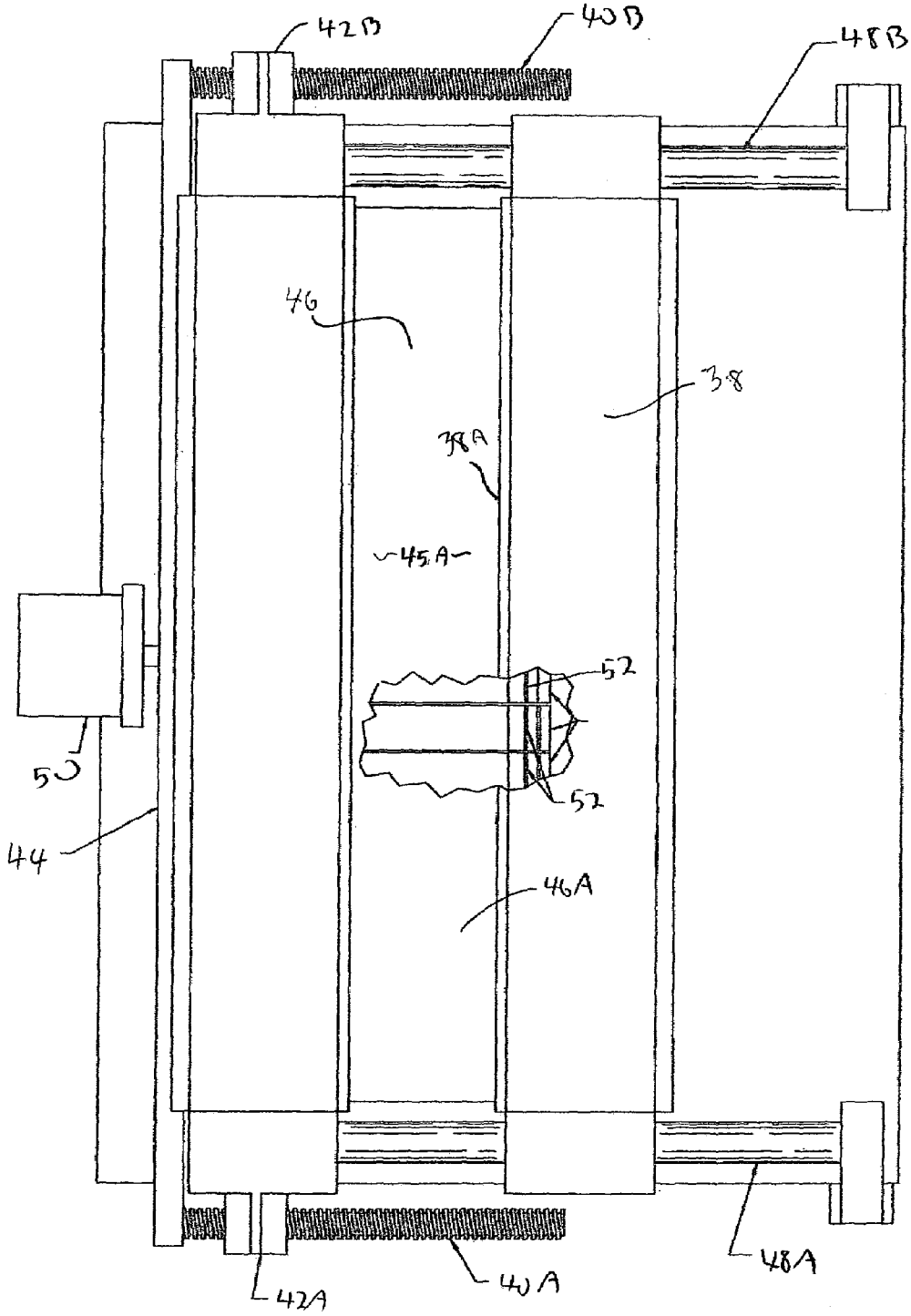
FIG. 4 is a plan view of the stack conditioning apparatus of FIG. 3.

The present invention is directed to an apparatus for conditioning a stack of coated sheets so the stack can be bound using a conventional thermal adhesive binder strip. Referring again to the drawings, FIGS. 3 and 4 depict one embodiment of the subject conditioning apparatus. Preferably, the apparatus includes a housing 36 of a size suitable for desktop use. A clamping platen 38 is mounted for lateral movement on a pair of linear guide rails 48A and 48B. Platen 38 includes a vertical member 38A for holding a stack of sheets (not depicted in FIGS. 3 and 4) to be conditioned. A stack clamping carriage 44 is also mounted on the guide rails 48A and 48B for lateral movement. The clamping carriage 44 and platen 38 are coupled together by pair of heavy springs (not depicted) that apply a clamping force to a stack disposed in the cavity 45.

Figure 5:
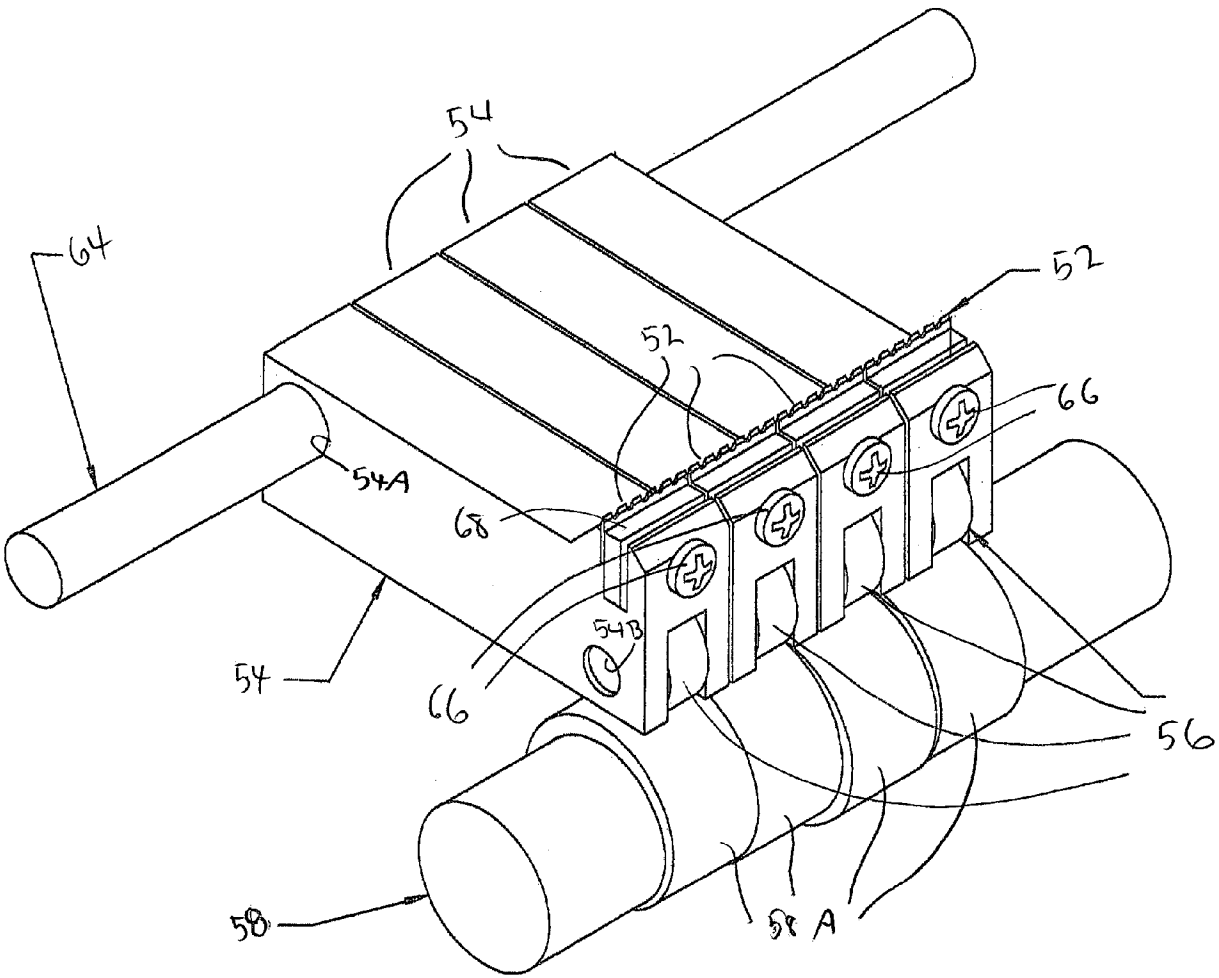
FIG. 5 is a perspective view of a portion of one embodiment of a stack piercing blade arrangement for use in the conditioning apparatus of FIGS. 3 and 4 for converting rotational drive motion into reciprocating motion for driving the blades.
Figure 6:
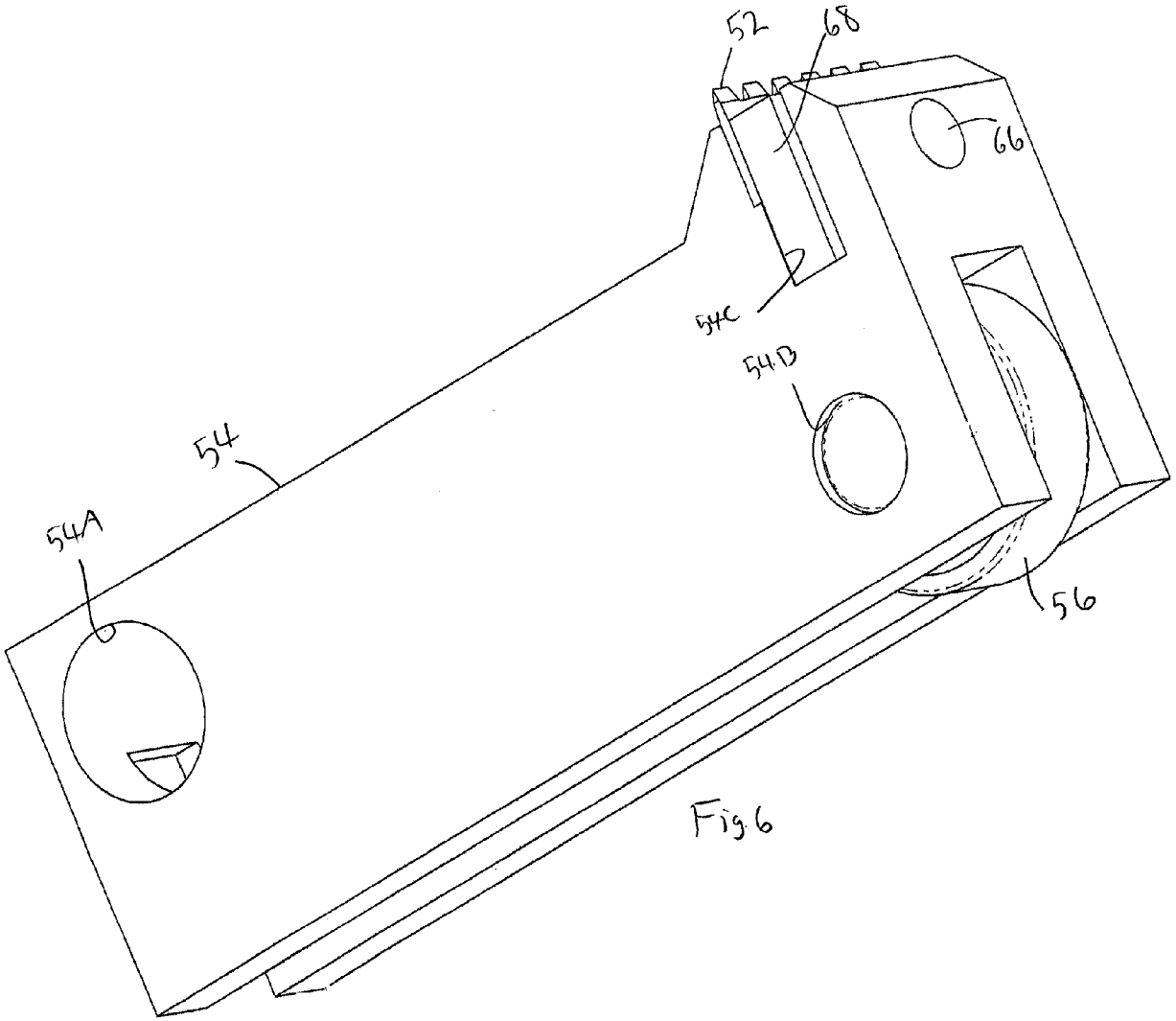
FIGS. 6 and 7 are perspective views of one embodiment of a piercing blade holder member.
Figure 7:
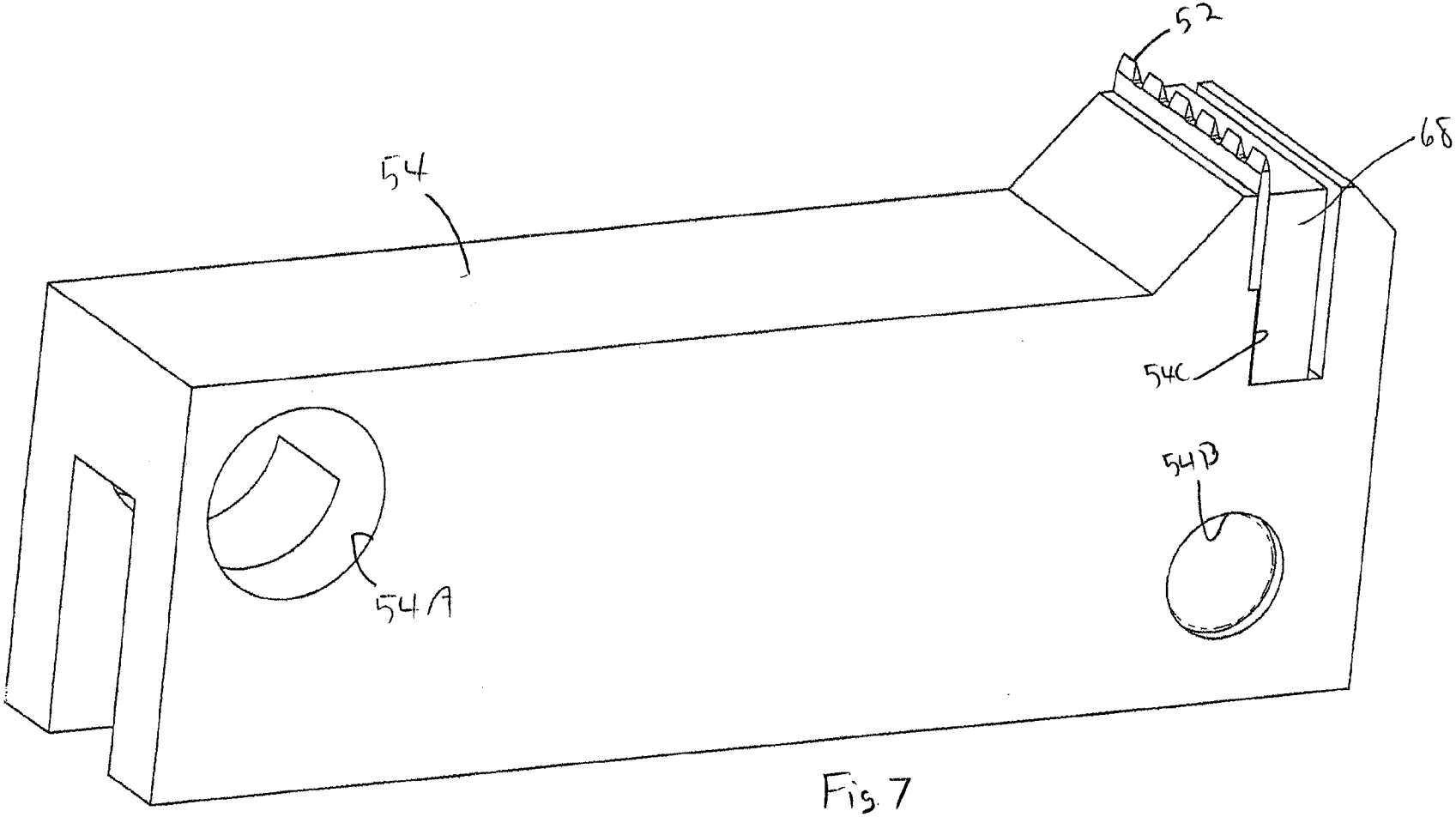
Figure 8:
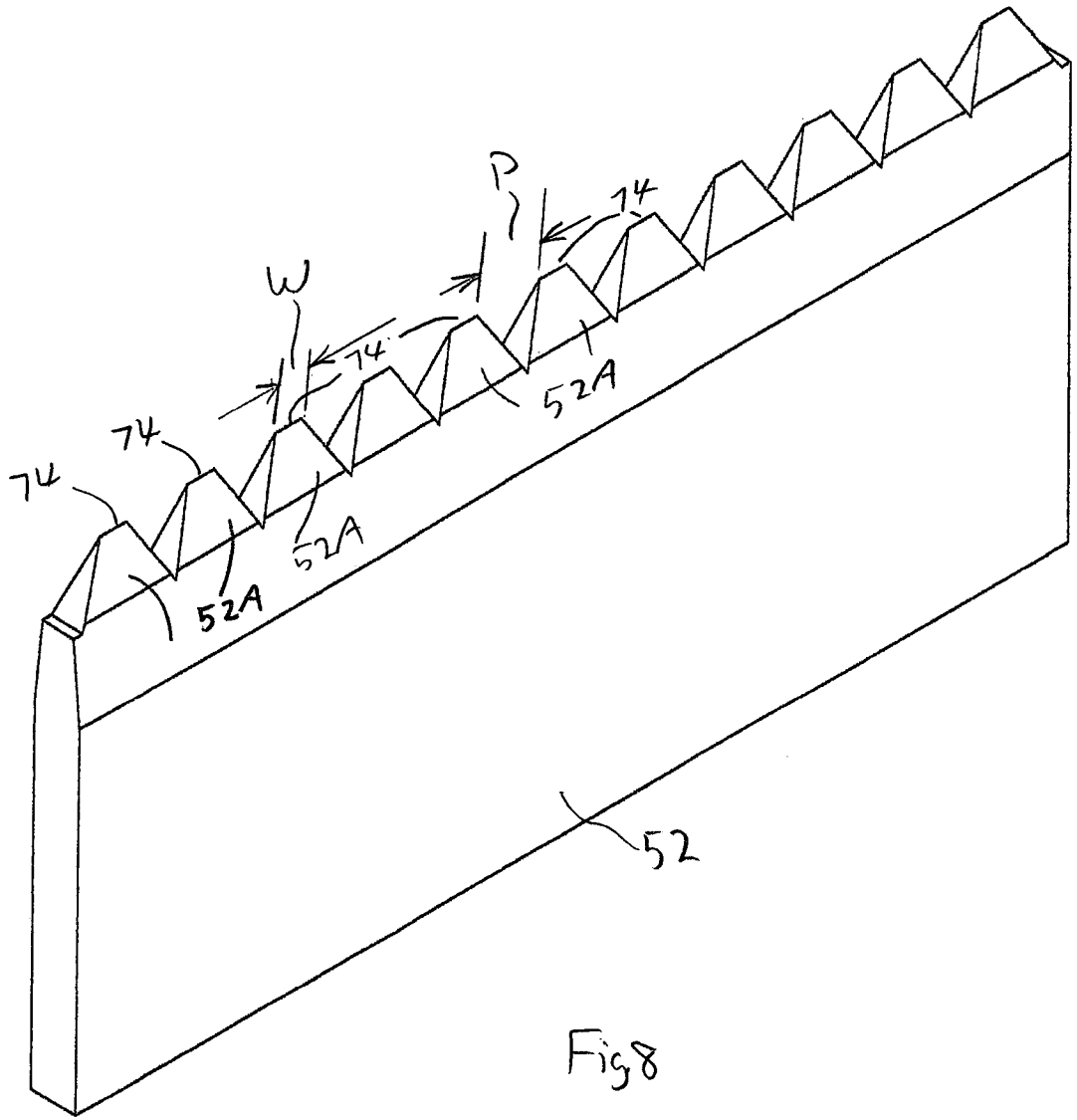
FIG. 8 is a perspective view of an exemplary piercing blade showing the individual piercing elements.

Clamping carriage 44 carries a pair of drive nuts 42A and 42B which receive respective lead screws 40A and 40B. The lead screws 40A and 40*b* are driven together in either direction by an indexing stepper motor 50. A drive belt (not depicted) couples the motor 50 output to the two lead screws. A stack support member 46 is cantilevered mounted below the clamping carriage 44 and clamping platen 38 and includes a surface 46A. The carriage 44, platen 38 and support member surface 46A form a clamping cavity 45 for receiving a stack of sheets to be conditioned. A multiplicity of piercing blades 52, one of which is depicted in FIG. 8, are supported on respective blade holders 54. In the exemplary conditioning apparatus, there are a total of twelve separate blade holders 54, with the blades 52 being aligned along a common axis. As will be explained in greater detail, the blades function to pierce the edge of each individual sheet of the stack. The use of multiple piercing blades 52, which are driven into the stack at differing times, function to reduce the amount of driving force needed and thus permit the use of a smaller drive motor and other related components. This feature also reduces noise and vibration. FIG. 5 shows four of the twelve blade holders 54 and the associated structure. FIGS. 6 and 7 show further details of the individual blade holders 54.

The piercing blades 52, which are preferably made of ceramic, are each provided with several individual piercing elements 52A (FIG. 8). In the exemplary piercing blade of FIG. 8, there are eleven piercing elements. Each piercing element 52A terminates in a wedge that defines a relatively sharp cutting edge 74 which has a width W of typically 0.025 inches. The spacing P between the edges is typically 0.025 inches. The use of multiple, spaced apart, piercing elements 52A has been found to produce superior results and to further reduce the required driving force. The piercing blades 52 are each approximately one inch in length thereby providing a total length of twelve inches so that stacks with edges of up to twelve inches can be accommodated.

Each piercing blade 52 is secured in a recess 54C formed in the blade holder 54. A blade support block 68 and associated set screw 66 function to hold the blade in place and permit easy blade replacement. The blade holders 54 each have rear openings 54A for pivotally mounting the holder on a common pivot shaft 64 (FIG. 5). The blade holders 54 are driven by a common camshaft 58 having a separate cam surface 58A for each of the blade holders. The respective cam surfaces 58A each engage a cam follower bearing 56 mounted on each of the blade holders. Although not shown, each blade holder 54 includes a return spring connected to hold the cam follower bearing 56 down on to the cam surface 58A. These springs assist in retracting the blades 52 from the stack and force the cam follower bearing 56 to follow the contours of the cam surfaces. The cam surfaces 58A are configured so that, for each complete rotation of the camshaft 58, each of the blade holders 54 will cause each of the piercing blades 52 to reciprocate between a withdrawn position and a piercing position. The amount of blade movement above the surface 46A, which defines the location of the stack edge to be conditioned, is typically between 0.010 and 0.030 inches.

Given the substantial distance between pivot shaft 64 and the location of the blade 52 on the holder, this reciprocating blade movement will fall in a piercing plane that is substantially orthogonal to the stack receiving surface 46A. As used herein, blade movement falls substantially within a piercing plane if the angle of movement is within ±25 degrees of the angle of the plane. Preferably, each of the cutting edges 74 of all of the twelve blades 52 in the exemplary conditioning apparatus fall within this piercing plane. Further, as used herein, a plane defined by at least by that region of the sheet near the edge of the stack to be conditioned is said to be substantially coincident with a plane such as the piercing plane if all of the angles between the respective planes are each within ±25 degrees. As will be explained in greater detail, each sheet of the stack, at least in the region near to edge of the stack being conditioned, will define a sheet plane that will pass through, and be substantially coincident with, this piercing plane. During this relative movement, the blade 52 will be activated at a frequency to ensure that each sheet of the stack is pierced at least once. Note that the stack front and rear cover sheets are secured in place by the outer adhesive bands 20B (FIG. 2) and thus do not rely upon the central adhesive 20C. Such cover sheets do not require conditioning in accordance with the present invention are not considered to be one of the sheets of the stack. However, it does no harm to condition the edges of the cover sheets.

Operation of the subject conditioning apparatus will now be described. It should be noted that motor 50 and other drive elements can be readily controlled by a suitably programmed micro-controller which receives inputs from various position sensors and the like. The particular implementation of such a micro-controller can be readily carried out by those skilled in the art based upon the present disclosure. Thus, such details will not be described so as to avoid obscuring the true nature of the present invention in unnecessary detail.

Referring to FIGS. 3 and 4, prior to actuation of a control panel switch (not depicted), the clamping platen 38 and clamping carriage 44 are in a home position for receiving a stack of sheets to be conditioned. In this home position, the stack support member receiving surface 46A is exposed to receive a stack to be conditioned. A pair of relatively strong springs (not depicted), disposed along the respective linear guide rails 48A and 48B, are couple between the platen 38 and carriage 44 and operate to pull the platen towards the carriage. A stop (not depicted) prevents the clamping platen 38 from being pulled closer to the platen 38 than shown in FIGS. 3 and 4. A user first places the stack to be conditioned in the clamping cavity 45, with the stack edge to be conditioned resting on surface 46A. The user then actuates the control panel switch (not depicted) causing stepper motor 50 to drive the clamping carriage 44 by way of the two lead screws 40A and 40B. The direction of movement is towards the stack and the clamping platen 38 on the other side of the stack. The stack is gripped between the extended surfaces associated with clamping carriage 44 and platen 38 to within 0.030 to 0.050 inches from surface 46A thereby preventing the reciprocating blades from contacting the carriage and platen.

Figure 9:
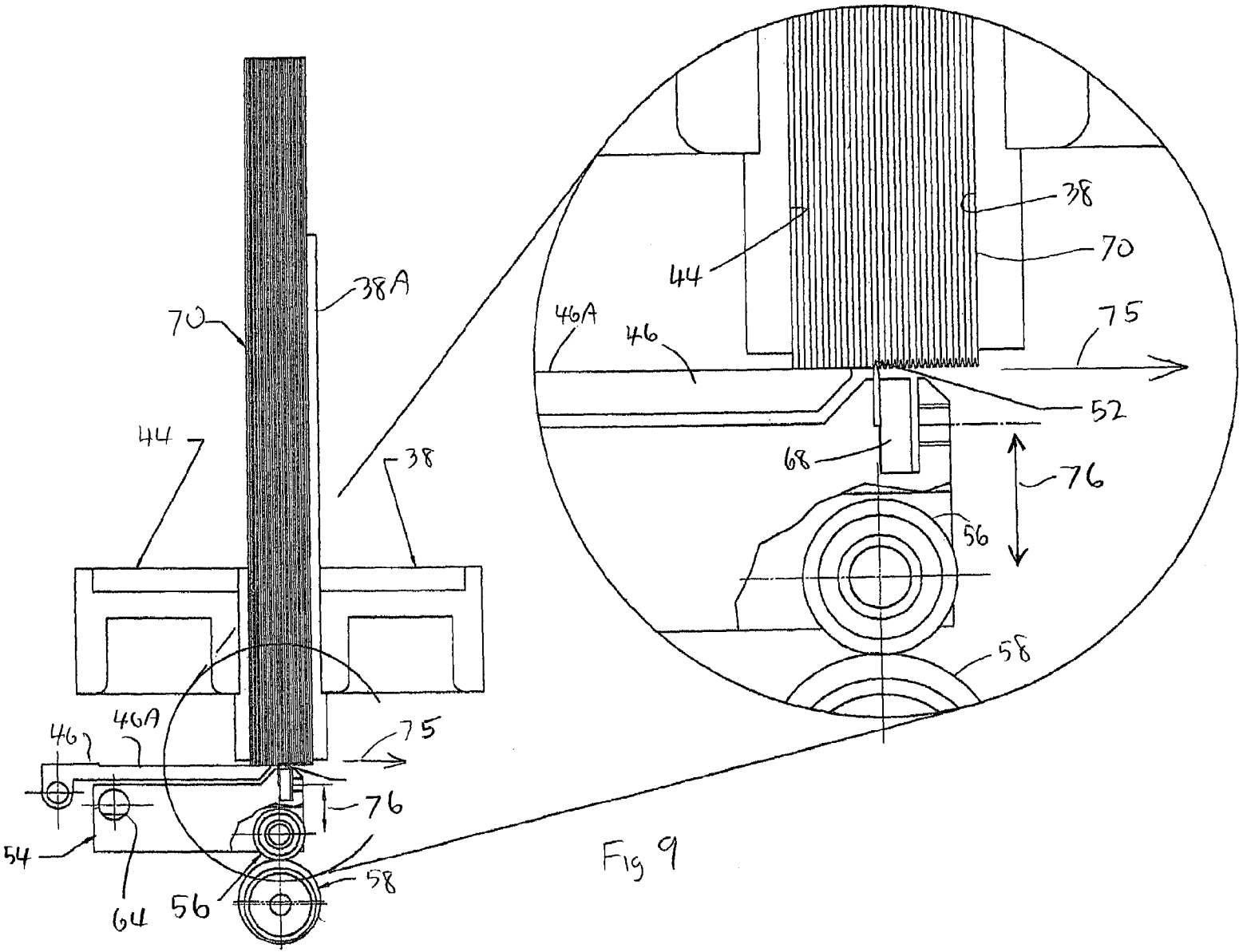
FIG. 9 is a side elevational view of the conditioning apparatus of FIGS. 3 and 4 showing a stack being conditioned.

Eventually, the driven clamping carriage 44 will contact the stack and will proceed to move the stack and the clamping carriage 38 together, as represented by arrow 75 shown in FIG. 9. Carriage 44 will then start to drive the stack 70 off of the stack support member 46 as shown in FIG. 9 and over the piercing blades 52. While this is occurring, the two springs coupling the carriage 44 and platen 38 together will continue to apply a substantial compression force to the lower portion of the stack 70. This causes the stack 70 to form an essentially solid block so that the individual sheets support one another and are not deflected during the conditioning process.

While the stack 70 is being driven over the piercing blades 52 at a controlled rate, the blades 52 are caused to reciprocate by blade drive motor 62 and the camshaft 58. This reciprocating movement is represented by arrow 76. Assuming that the thickness of the individual sheets of the stack 70 is N inches, the stack is driven in incremental steps of N inches or less. After each of these steps, the piercing blades 52 are reciprocated between the withdrawn position and the piercing position. This insures that each individual sheet of the stack is pierced. Preferably, each advance is only a fraction of the sheet thickness N to add a margin of safety since it is important that each sheet (excluding front and rear cover sheets) be pierced. An advance of ½ of N has been found satisfactory. Thus, for a typical sheet thickness of 0.004 inches, the stack is advanced 0.002 inches prior to each piercing. Stepper motor 50 and drive motor 62 are synchronized to ensure this relationship. Thus, at the end of every 0.002 inches of stack travel, the stepper motor 50 pauses and the drive motor 62 causes camshaft 58 to be rotated 360 degrees. This causes each of the twelve blade holders 54 to be sequentially driven so that each of the twelve blades 52 sequentially pierces the sheets of the stack 70. As previously noted, the blades 52 are set to pierce the sheets of the stack in a typical range of between 0.010 and 0.030 inches.

Figure 10:
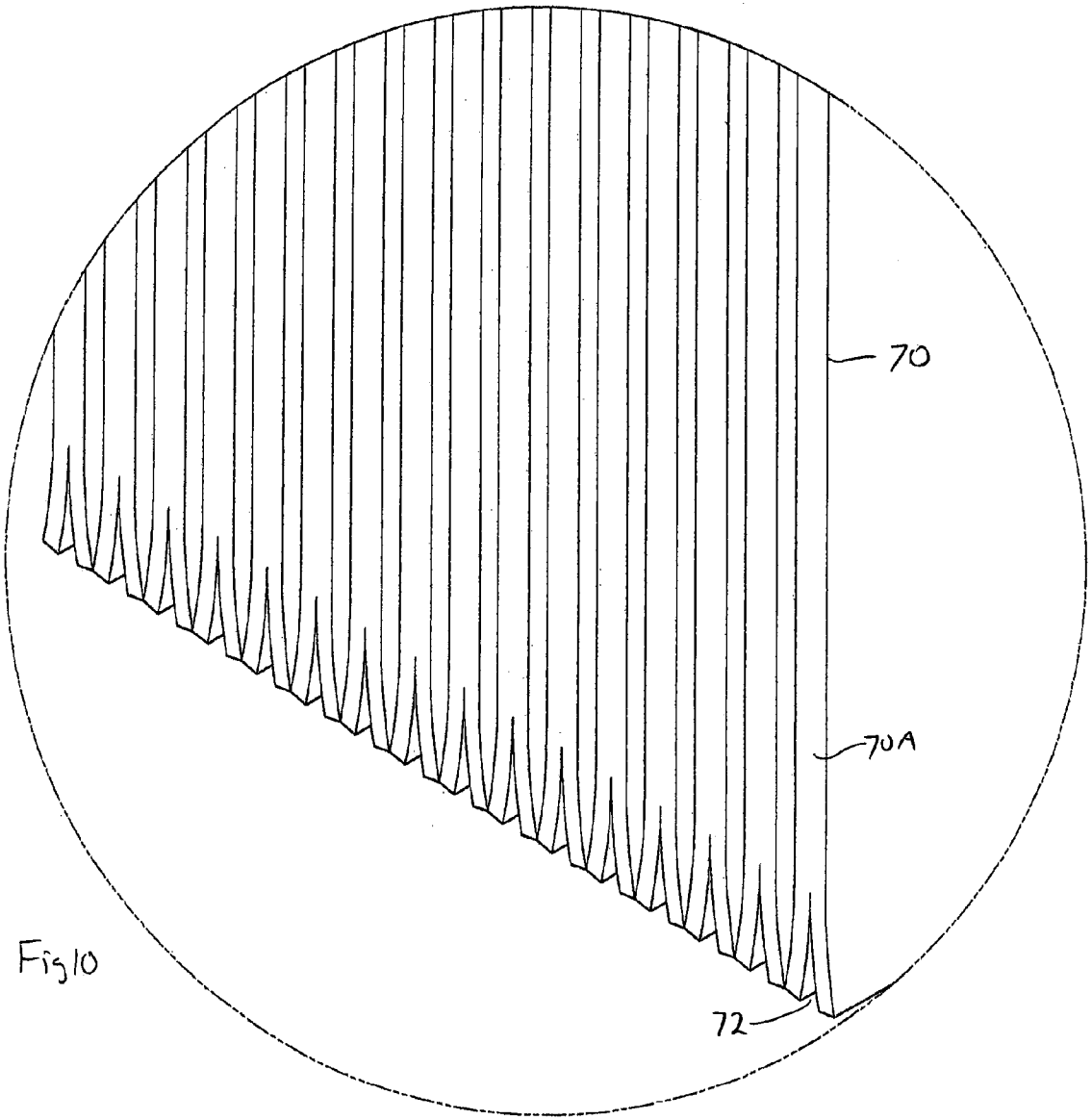
FIG. 10 is an enlarged perspective view of a portion of an edge of a stack conditioned in accordance with one embodiment of the subject invention.

Once the inner surface of the clamping carriage 44 has reached the piercing plane defined by the reciprocated motion of the individual piercing elements 52A of the twelve piercing blades 52, the stepper motor stops advancing the stack 70. The next step is to return the stack to the home position so that the conditioned stack can be removed. FIG. 10 illustrates a portion of the conditioned stack 70. As can be seen, each of the individual sheets 70A is pierced so that the ends of the sheet are split by the cutting edges 74 of the wedge-shaped piercing elements 52A (FIG. 8). When this occurs, there is a tendency for the fibers of the sheet to tear so that a split is formed in the paper in the region intermediate the points at which adjacent ones of the piercing elements 52A enter the sheet edge.

Figures 11A, 11B, 11C:
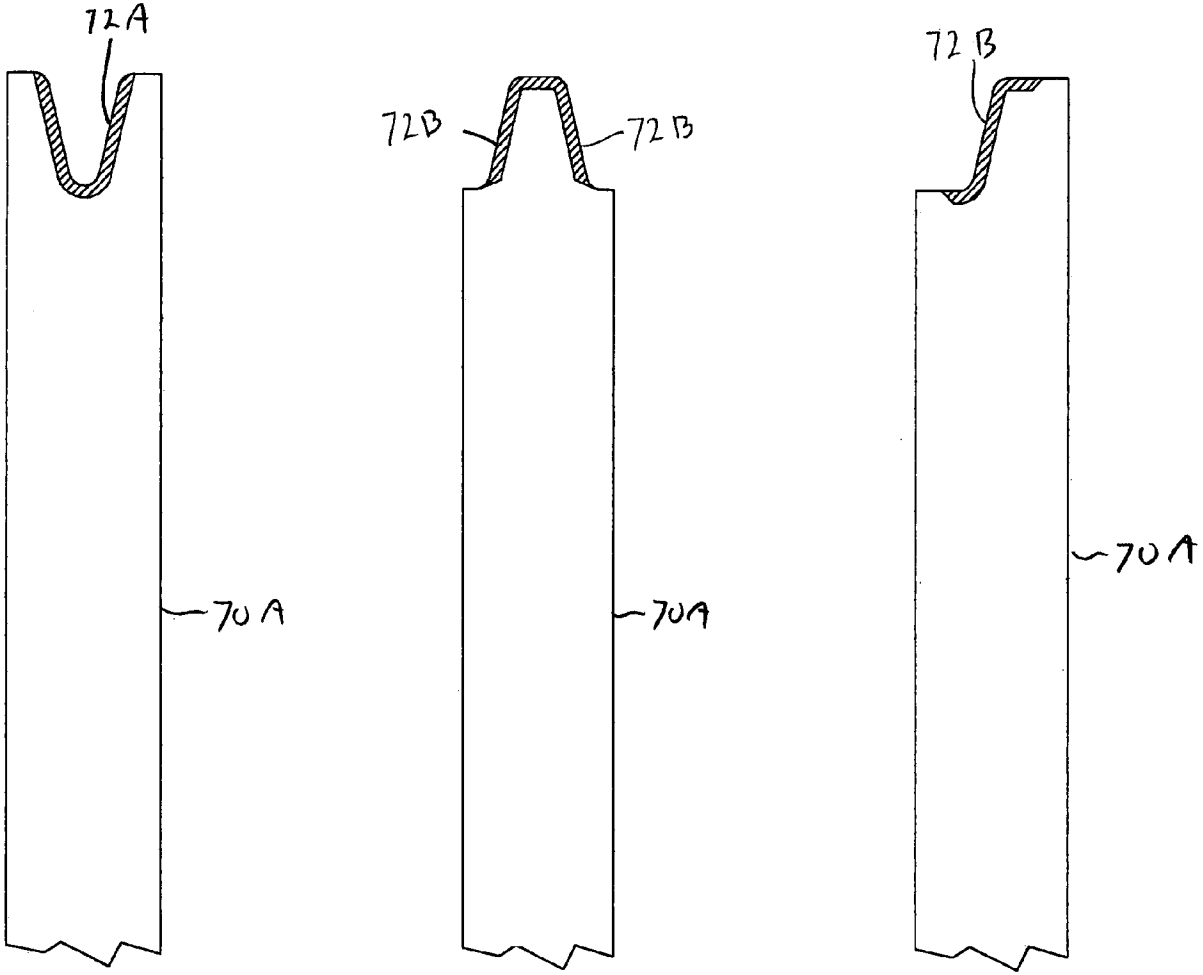
FIGS. 11A, 11B and 11C are respective side elevational views of the edges of thee exemplary individual sheets of a stack conditioned in accordance with one embodiment of the subject invention.

Although FIG. 10 shows a conditioned stack with splits 72 formed in each sheet, these results are somewhat idealized. FIGS. 11A, 11B and 11C show more typical examples of individual sheets of a stack that has been conditioned in accordance with the present invention. The example of FIG. 11A, a true split 72A is created in a sheet 70A, similar to the splits shown in FIG. 10. This results in a pair of opposing surfaces generally being exposed. In the example of FIG. 11B, it can be seen that sheet 70A has been pierced twice by the piercing element exposing a pair of surfaces 72B. A further example is shown in FIG. 11C where a sheet 70A is pierced in a location such that, rather than forming a split, a single surface 72B is exposed. An individual sheet may have variations of each of these examples along the entire edge of the sheet. Preferably, at least 10 percent and preferably at least 50 percent of the linear length along the edge of the sheets is pierced or torn by the individual piercing elements 52A, to achieve a reliable bind.

Figure 1:
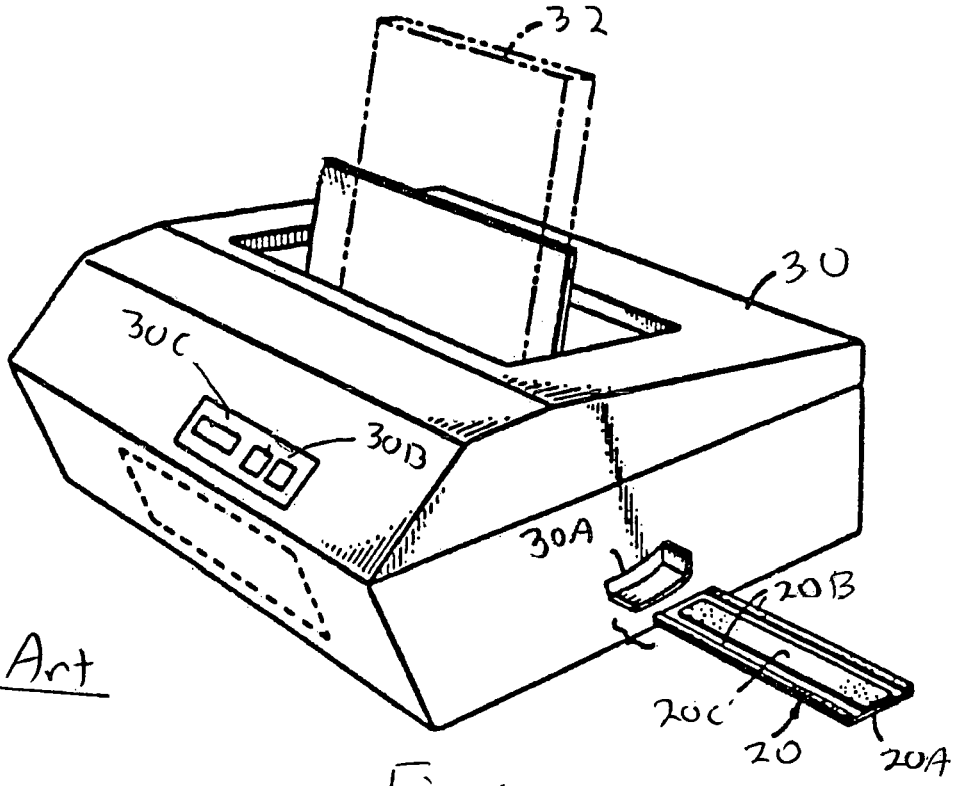
Prior Art Fig. 1
FIG. 1 is a perspective view of a conventional binding machine for use in binding stacks of sheets, including stacks conditioned in accordance with the present invention.
Figure 2:
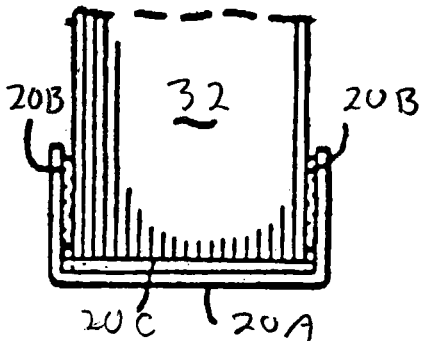
Prior Art FIG. 2
FIG. 2 is an end elevational view of a stack of sheets bound by conventional thermally activated adhesive binder strips using the binding machine of FIG. 1.
Figure 12:
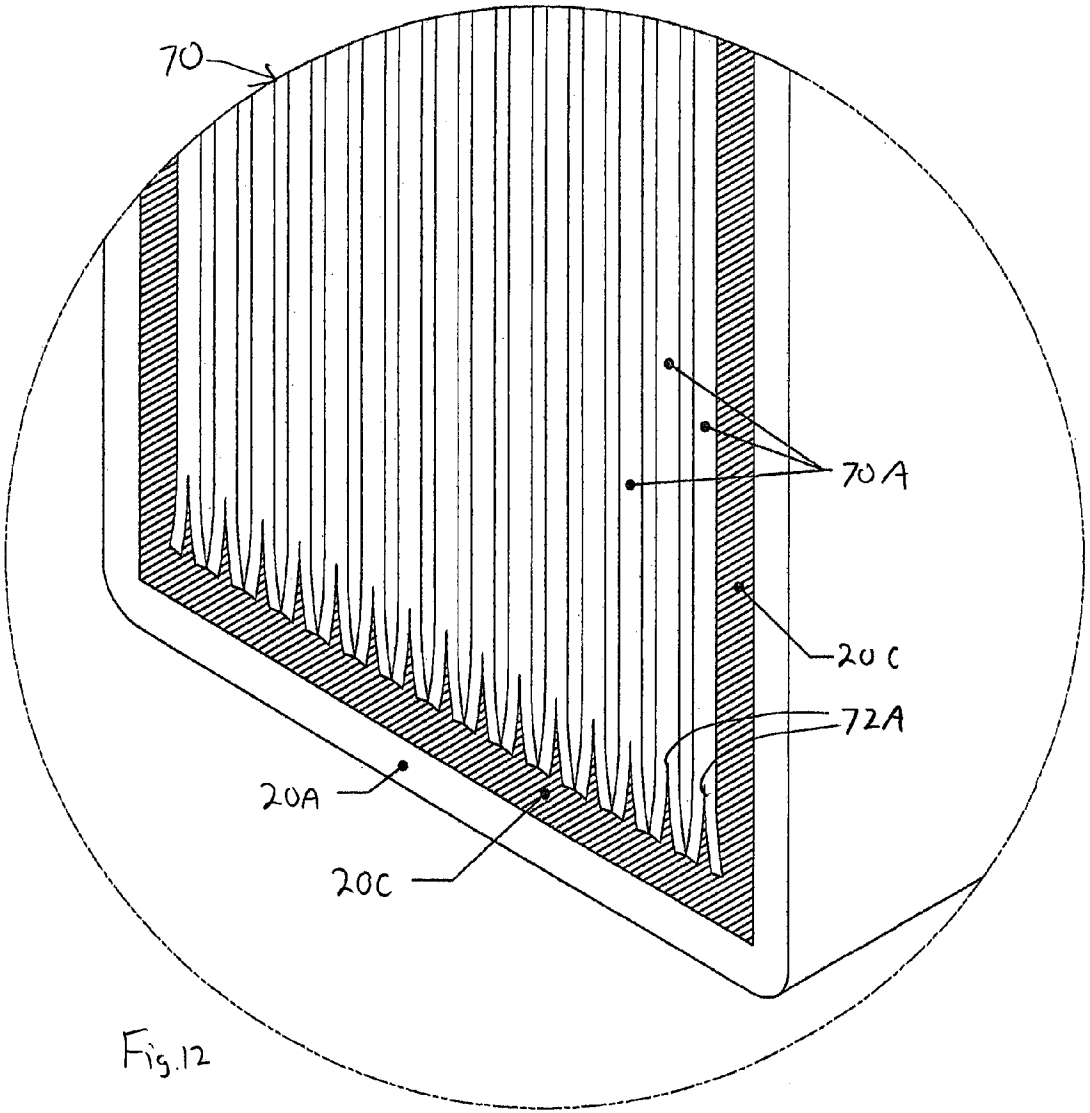
FIG. 12 is a perspective view of a portion of a stack conditioned in accordance with one embodiment of the present invention after the stack has been bound using a conventional thermal binder strip.

In all of the examples of FIGS. 11A–11C, a significant amount of surface area of the fibrous center of the coated paper sheet 70A has been exposed. This is due in part to the fact that the above-described reciprocating action of the piercing blades 52 tends to result in relatively large exposed surfaces that are roughly parallel to the plane of the sheets 70A. These types of exposed surfaces, which are reliably formed on each sheet of the stack, cannot be achieved using prior art methods that somewhat randomly apply abrading action to the stack edge. FIG. 12 shows a portion of a stack conditioned in accordance with the subject invention and which has been bound using a conventional binder strip 20 and conventional binding machine 30 as depicted in FIGS. 1 and 2. It can be seen that the low viscosity adhesive 20C is adhering to the exposed inner fibrous surfaces of each of the individual sheets. This results in a bound volume where each individual sheet, whether coated or not, is securely held in place.

Figure 14:
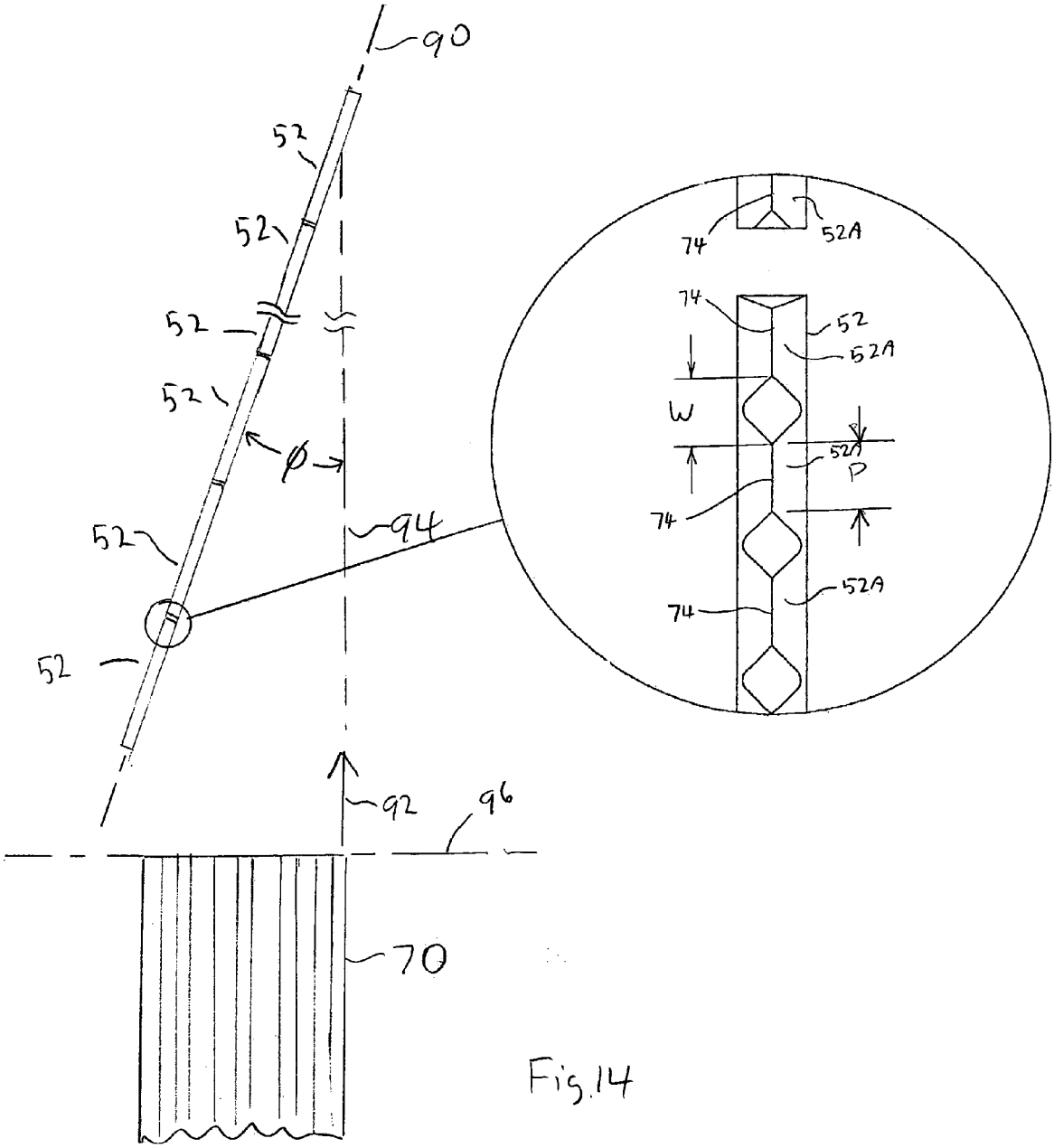
FIG. 14 is plan view of a further embodiment of the present invention.

FIG. 14 shows a plan view of a further embodiment of the present invention. Rather than aligning the piercing blades so that the blades are aligned along an axis that is generally orthogonal to the planes of the sheets of the stack, the ceramic blades 52 of this embodiment are aligned on axis 90 that is substantially parallel to the sheet planes. The stack 70 to be conditioned is supported by a clamping mechanism (not depicted) that moves the stack in the direction represented by arrow 92 along axis 94, with this axis being the longitudinal axis of the edge of the stack. This embodiment is particularly applicable to the previously-described prior art perfect binding equipment in that such equipment already includes stack clamping mechanisms for supporting a stack in this manner and for driving the stack along the longitudinal axis of the stack edge. The stack 70 is moved along axis 94 through an array of piercing blades 52. The piercing blades 52 are arranged so that the edges 74 of the blades fall in a piercing axis 90. The piercing axis 90 is disposed at an acute angle θ with respect to axis 94. Preferably, the angle is at least 1 degree and less than 15 degrees.

The piercing elements 52A are arranged so that each sheet of the stack will be repeatedly pierced by the elements during the conditioning process. It in not practical to position the individual piercing elements 52A on axis 96 so as to pierce each sheet of a typical sheet of 0.004 inches width. The cutting edges 74 must be supported by a structure that is wider than this dimension. It has been found that positioning the cutting edges 74 along an acute angle with respect to the plane of the sheets permits the cutting edges to be positioned so that each sheet is pierced as desired. In the exemplary embodiment of FIG. 14 where it is assumed that the typical sheet thickness is about 0.004 inches wide, angle θ is set to 4 degrees (FIG. 14 is not drawn to scale). As previously noted, the length P of the cutting edges 74 is 0.025 inches that are spaced a distance W of 0.025 inches apart. With this configuration, the spacing of the cutting edges 74 relative to axis 96 of FIG. 14 is 0.002 inches. Thus, each individual sheet of sheet of the stack will be aligned with at least one of the cutting edges 74 when the stack is driven along axis 94. Assuming for example that the stack width is about 1 inch wide, about fifteen individual piercing blades 52, each approximately 1 inch long, will be arranged along axis 90 to provide a total length of at about 15 inches. For greater stack thickness, the length of the array is increased accordingly. The spacing of the cutting edges 74 and the magnitude of angle θ can be also be adjusted to accommodate the particular sheet thickness of the stack to be conditioned.

Each blade 52 of the FIG. 14 array has a separate blade holder 54, such as shown in FIGS. 6 and 7, which is driven at differing times so as to reduce the amount of required driving force. The driving mechanism could be the cam drive shown in FIG. 5 or the crank shaft approach of FIGS. 13A and 13B or some other arrangement. Preferably, given the spacing and dimensions of the individual piercing elements 52A, each of the blades 52 is driven for every 0.040 to 0.060 inches of stack movement along axis 94 to provide sufficient stack conditioning. As previously described in connection with the previous embodiment, this is accomplished by rotating the drive shaft one turn of each of such advance in stack movement. This conditioning results in pierced sheets similar to that shown in FIGS. 11A, 11B and 11C. The fact that the cutting edges 74 are offset from the planes of the individual sheets by a small amount, 4 degrees in the present example, does not significantly reduce the effectiveness of the conditioning.

It should be noted that other piercing blade 52 configurations could be used other than arranging all of the blades along a common cutting axis 90 as shown in FIG. 14. The blades 52 should be arranged so that the respective cutting edges 74 are disposed relative to axis 96, the axis normal to stack movement, with spacing sufficiently small relative to the thickness of the individual sheets to ensure that each sheet is pierced as the stack is moved. Furthermore, the blades should be driven such that an undue amount of driving force is not required so as to reduce the size of the driving motor and associated structure and to reduce operating vibration and noise.

Thus, various novel methods and apparatus for conditioning a stack of sheets prior to binding have been disclosed. Although various exemplary embodiments have been described in some detail, it is to be understood that certain changes can be made without departing from the spirit and scope of the subject invention as defined by the appended claims. For example, after a first pass of the stack 70 over the piercing blades, 52, the stack is returned to the home position, by the clamping platen 38 and clamping carriage 44 as shown in FIG. 9. If desired, further conditioning can be carried out during this return. In that case, prior to the return, the relative positions of the stack 70 and the piercing elements 52A (FIG. 8) are laterally shifted slightly so that the regions of the sheets not piercing during the first pass are subjected to piercing in the return pass. This can be accomplished by shifting the blade holders 54 (or the stack clamping apparatus) laterally a slight amount so that the elements 52A are aligned, relative to the sheet ends, in the position intermediate two adjacent piercing elements 52A used in the first conditioning sequence pass.

Figure 13A:
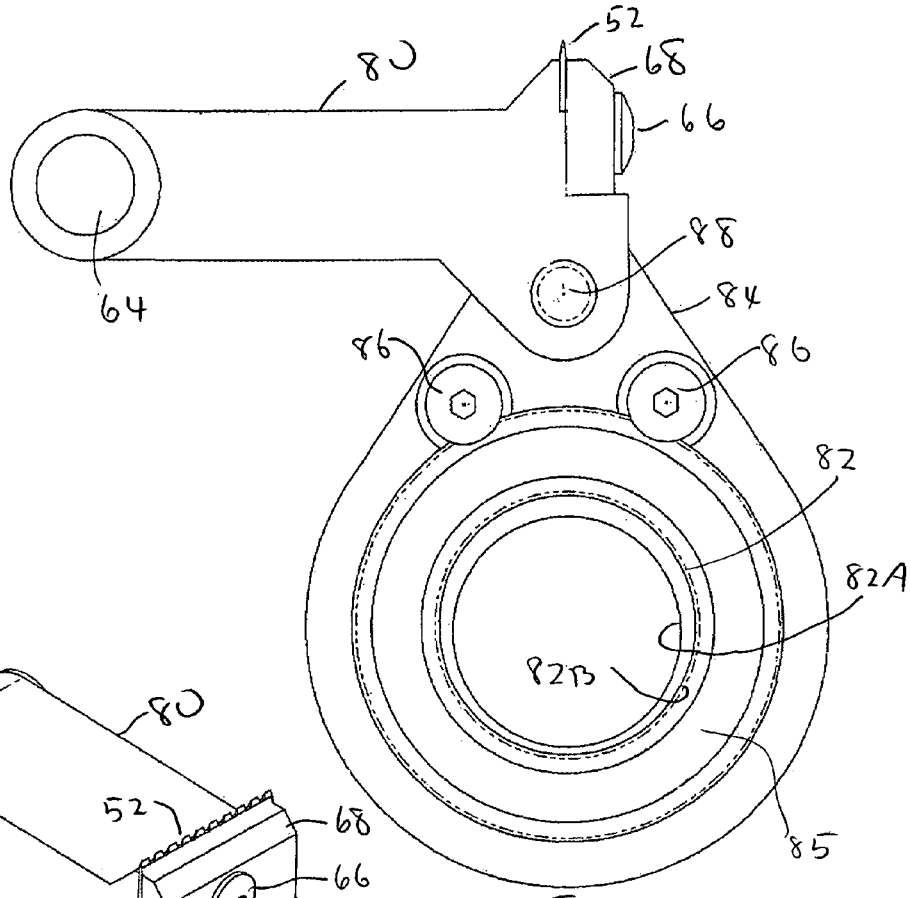
FIGS. 13A and 13B are respective side elevational and perspective views of another embodiment stack piercing blade arrangement which uses a crank assembly for converting rotational drive motion into reciprocating motion for driving the blades.
Figure 13B:
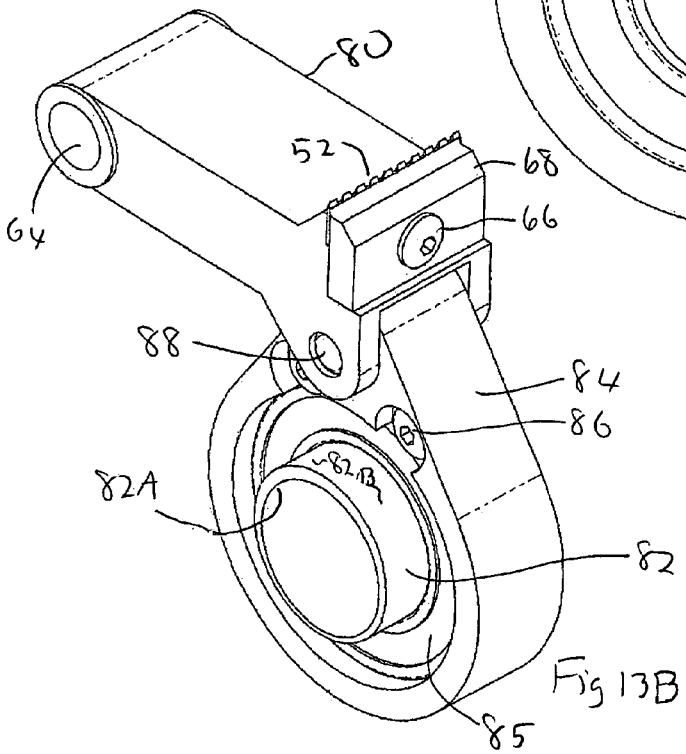

Also, it would be possible to other configurations for producing the reciprocating movement of the piercing blades 52. By way of example, a crank and connecting rod approach for providing as an alternative to the camshaft 58 arrangement (FIG. 5) is shown in FIGS. 13A and 13B. A crank assembly 82 is provided having a central bore for receiving a drive shaft (not depicted). The assembly 82 has a cylindrical geometry, with the center of the inner surface 82A being slightly offset from the center of the outer surface 82B. The crank assembly 82 is secured within a connecting assembly 84 by way of bearings 85 which are held in place by screws 86. Connecting assembly 84 is provided with an extension for connecting the assembly to a blade holder 80. A connecting pin 88 functions to pivotably secure the connecting assembly to the blade holder. Thus, when the crank assembly 84 is rotatably driven by the drive shaft about the center of the inner surface 82A, the output surface 82B will define an offset circular path. This motion will be converted to the desired reciprocating motion of piercing blade 52 by the connecting assembly 84 together with the blade holder 80 and associated components. The displacement of the blade is determined by the magnitude of the offset between the inner and outer crank assembly surfaces 82A and 82B.

The invention claimed is:

1. Apparatus for conditioning an edge of a stack of a plurality of sheets to be bound comprising:

a stack clamping mechanism configured to secure the stack of sheets;

a piercing member configured to produce piercing member movement, with said piercing member movement being substantially limited to a single piercing plane;

a positioning mechanism configured to control a relative movement of the stack clamping mechanism and the piercing mechanism so that the sheets of the stack pass through the piercing plane; and a drive mechanism configured to drive the piercing member into the edge of the stack at least once for each sheet of the stack passing through the piercing plane.

2. The apparatus of claim 1 wherein the sheets of the stack of sheets each define a sheet plane in a region near the edge of the stack and wherein the positioning mechanism causes the sheet planes to substantially coincide with the piercing plane when the stack passes through the piercing plane.

3. The apparatus of claim 2 wherein the sheets of the stack each have an approximate thickness of N units and wherein the drive mechanism is configured to drive the piercing member into the stack at least once for every N units of relative movement of the stack and piercing member.

4. The apparatus of claim 3 wherein the drive mechanism is configured to drive the piercing member into the stack approximately twice every N units of the relative movement.

5. The apparatus of claim 1 wherein the piercing member includes a plurality of separate piercing elements, with each of the piercing elements having a cutting edge disposed in the piercing plane.

6. The apparatus of claim 5 wherein the drive mechanism further includes a support member, said support member being pivotally mounted at a first location on the support member and with said support member securing the piercing member at a second location spaced apart from the first location, with said support member being pivoted about the first location so that the piercing member is moved between a withdrawn position and a piercing position.

7. The apparatus of claim 6 wherein the stack clamping mechanism is configured to secure the stack of sheets so that the edge of the stack is positioned along a support plane, with the piercing member being disposed on one side of the support plane in the withdrawn position and with the piercing member extending past the support plane at least a distance of 0.01 inches into another side of the support plane in the piercing position.

8. The apparatus of claim 5 further including a multiplicity of said piercing members, with the piercing movement of each of the piercing members being substantially in the piercing plane.

9. The support member of claim 8 wherein the drive mechanism further includes a support member associated with each of the piercing members, each of said support members being pivotally mounted at a first location on the support member and with said support member securing the associated piercing member at a second location spaced apart from the first location, with said support members being pivoted about the first location so that the associated piercing member is moved between a withdrawn position and a piercing position.

10. The apparatus of claim 9 wherein the stack clamping mechanism is configured to secure the stack of sheets so that the edge of the stack is positioned along a support plane, with the piercing members being disposed on one side of the support plane in the withdrawn position and with the piercing members extending past the support plane at least a distance of 0.01 inches into another side of the support plane in the piercing position.

11. The apparatus of claim 10 wherein the drive mechanism is configured to sequentially drive each of the piercing members so that the piercing members arrive at the piercing position at a differing point in time so that one of the piercing members arrives at the piercing position at a time different than another one of the piercing members.

12. The apparatus of claim 11 wherein the drive mechanism includes a camshaft having a separate cam surface associated with each of the support members, with the cam surfaces engaging associated cam follower bearings mounted on the support members.

13. The apparatus of claim 11 wherein the drive mechanism includes a drive shaft and a converting mechanism for converting a rotational motion of the drive shaft into reciprocating motion to drive each of the support members.

14. The apparatus of claim 13 wherein the drive mechanism includes a crank assembly driven by the drive shaft and a connection assembly associated with each of the support members connecting the crank assembly and the associated support member.

15. The apparatus of claim 1 wherein the piercing member includes at least one ceramic cutting element.

16. The apparatus of claim 15 wherein the piercing member includes a multiplicity of separate ones of the cutting elements.

17. The apparatus of claim 1 further including a multiplicity of said piercing members, with the piercing movement of each of the piercing members being substantially in the piercing plane and wherein the drive mechanism is configured to drive at least some of the piercing members to the piercing position at a differing point in time with respect to one another so that one of the piercing members engages the stack at a time different than another one of the piercing members.

18. Apparatus for conditioning an edge of a stack of sheets to be bound comprising:

a stack clamping mechanism configured to secure the stack of sheets, with at least a region of the sheets of the stack near the edge being parallel to a piercing plane;

a piercing member including a piercing edge movable substantially exclusively in the piercing plane;

a positioning mechanism configured to control relative movement of the stack clamping mechanism and the piercing member; and a drive mechanism configured to cause the piercing edge to reciprocate in the piercing plane between a withdrawn position displaced from the stack and a piercing position contacting the stack at least once for every sheet in the stack.

19. The apparatus of claim 18 wherein the piercing edge includes ceramic.

20. The apparatus of claim 18 wherein said piercing member includes a plurality of spaced apart ones of the piercing edges, with all of the piercing edges moveable substantially in the piercing plane.

21. The apparatus of claim 18 further including a plurality of the piercing members, with each of the piercing members including a multiplicity of the piercing edges, with the piercing edges movable substantially in the piercing plane and wherein the driving mechanism is further configured to cause each of the piercing members to be sequentially reciprocated so that the piercing edges of each of the respective piercing members contact the stack at differing points in time so that one of the piercing members contacts the stack at a time different than another one of the piercing members.

22. The apparatus of claim 21 wherein the piercing edges include ceramic.

23. The apparatus of claim 17 further including a plurality of the piercing members, with each of the piercing members including a multiplicity of the piercing edges, with the piercing edges movable substantially in the piercing plane and wherein the driving mechanism is further configured to cause the piercing members to be reciprocated at differing points in time so that one of the piercing members engages the stack at a time different than another one of the piercing members.

24. Apparatus for conditioning a stack of sheets to be bound comprising:

a stack clamping mechanism configured to secure the stack of sheets, with at least a region of each of the sheets of the stack near the stack edge defining respective outer parallel sheet planes, with all of the sheets of the stack being disposed intermediate said sheet planes and with said sheet planes being normal to a stack edge plane disposed at the stack edge;

a piercing member including a piercing element, with said piercing element movable substantially exclusively in a single piercing plane;

a positioning mechanism configured to control relative movement of the stack clamping mechanism and the piercing plane so that the sheet planes of each of the sheets sequentially pass through, and become momentarily, substantially coincident with, the piercing plane; and a drive mechanism configured to cause the piercing element to repeatedly engage the stack substantially exclusively through the stack edge plane and not through the sheet planes and to then disengage the stack substantially exclusively through the stack edge plane and not through the sheet planes during the relative moment.

25. The apparatus of claim 24 wherein the piercing element comprises a multiplicity of separate cutting edges that move substantially in the piecing plane.

26. The apparatus of claim 25 further including a plurality of the piercing members and wherein the drive mechanism is further configured to cause each of the respective piercing elements to sequentially engage and disengage the stack so that one of the piercing elements engages the stack at a differing point in time than another one of the piercing elements.

27. The apparatus of claim 24 wherein the drive mechanism is configured to engage the stack at least once for every sheet that passes through the piercing plane.

28. A method of conditioning an edge of a stack of sheets to be bound, said method comprising:

providing a piercing member;

supporting the stack so that a compression force is applied to the stack in a region near the edge of the stack;

periodically driving the piercing member into the edge of the stack in a first direction to engage the stack at a first location and withdrawing the piercing member from the first location at the edge of the stack in a second direction generally opposite the first direction; and moving the piercing member and the stack relative to one another at least once for each sheet of the stack so that each sheet of the stack is pierced by piercing member so that the edge of the stack is conditioned, with the conditioned edge being substantially linear before and after conditioning and with dimensions of the stack before and after conditioning being substantially constant.

29. A sheet conditioned in accordance with the method of claim 28.

30. The method of claim 28 wherein the piercing member includes a plurality of individual spaced apart piercing elements aligned along a common axis and wherein the periodically driving includes driving the piercing elements into the edge of the stack with the common axis being substantially parallel with the edge of the stack.

31. A sheet conditioned in accordance with the method of claim 30.

32. Apparatus for conditioning an edge of a stack of sheets to be bound comprising:

a stack clamping mechanism configured to secure the stack of sheets, with a region of the sheets near the edge lying within individual parallel sheet planes and with the edge of the stack being disposed in an edge plane generally normal to the sheet planes;

a piercing member configured to produce a piercing action in a piercing direction;

a positioning mechanism configured to control a relative movement of the stack clamping mechanism and the piercing member so that the sheet planes are substantially parallel to the piercing direction during such relative movement; and a drive mechanism configured to periodically drive the piercing member into the edge of the stack substantially exclusively through the edge plane so as to pierce the stack and to withdraw the piercing member from the edge of the stack substantially exclusively through said edge plane.

33. The apparatus of claim 32 wherein piercing member includes a multiplicity of separate piercing elements and wherein said positioning mechanism and said drive mechanism are configured so that each sheet of the stack is pierced by at least one of the piercing elements.

34. The apparatus of claim 32 where the positioning mechanism operates such that a longitudinal axis of the stack edge is generally orthogonal to a first axis and wherein the piercing member includes an array of separate piercing elements, with a number and lateral spacing of the piercing elements with respect to the first axis being such that each sheet of the stack is pierced by at least one of the piercing elements when the relative movement is along the longitudinal axis.

35. The apparatus of claim 34 wherein the piercing elements are all disposed along a piercing axis, with the piercing axis and the longitudinal axis of the stack edge being aligned with respect to one another at no greater than an acute angle.

36. The apparatus of claim 35 wherein the piercing axis and the longitudinal axis are at an angle that is at least one degree.

37. The apparatus of claim 36 wherein the acute angle is less than 10 degrees.

38. The apparatus of claim 35 further including a plurality of the piercing members, with each of the piercing members including a separate piercing blade, with each of the piercing blades including a multiplicity of the piercing elements aligned along the piercing axis and wherein the drive mechanism is further configured to drive each of the piercing members at differing points in time so that one of the piercing members is driven into the stack at a time different than another one of the piercing members.

39. Apparatus for conditioning an edge of a stack of sheets to be bound comprising:

a stack clamping mechanism configured to secure the stack of sheets, with a region of the sheets near the stack edge lying within individual parallel sheet planes and with the stack edge disposed in an edge Diane generally orthogonal to the sheet planes;

a piercing mechanism including a plurality of piercing members, with each of the piercing members including a piercing edge aligned along a single piercing axis common to all of the piercing members, with each of the piercing edges capable of reciprocating movement in a piercing direction substantially parallel with the sheet planes;

a positioning mechanism configured to control a relative movement of the stack clamping mechanism and the piercing mechanism so that a longitudinal axis of the edge of the stack is disposed at no greater than an acute angle with respect to the piercing axis; and a drive mechanism configured to periodically drive the piercing members so that the reciprocating movement causes the piercing edges to be driven at differing times into the edge of the stack so as to pierce the stack and away from the edge of the stack so that a first one of the piercing members engages the stack at a time different than a second one of the piercing members, with the piercing members entering and exiting the stack edge substantially exclusively though said edge plane.

40. The apparatus of claim 39 wherein the piercing members are positioned along the piercing axis such that a spacing of the piercing members relative to an axis normal to the longitudinal axis is at least equal to a width of the sheets of the stack so that each sheet of the stack is pierced by at least one of the piercing members.

41. The apparatus of claim 39 wherein the drive mechanism further includes a support member associated with each of the piercing members and wherein the drive mechanism is further configured to separately drive each of the support members so that the piercing members engage the stack at differing points in time.

42. The apparatus of claim 41 wherein the drive mechanism includes a drive shaft and reciprocating apparatus configured to convert rotational motion of the drive shaft to reciprocating motion.

43. The apparatus of claim 42 wherein the reciprocating apparatus includes, for each of the support members, a cam surface and a cam follower engaging the cam surface.

44. The apparatus of claim 42 wherein the reciprocating apparatus includes, for each of the support members, a crank assembly and a connecting assembly.

45. A method of conditioning an edge of a stack of sheets to be bound, said method comprising;

providing an array of piercing members disposed along a common axis;

supporting the stack so that a compression force is applied to the stack in a region near the edge of the stack, with the edge of the stack being substantially disposed in a single edge plane;

periodically driving the piercing members into the edge of the stack substantially exclusively through said edge plane so as to pierce the stack and withdrawing the piercing members from the edge of the stack substantially exclusively through said edge plane a multiplicity of times; and moving the array of piercing members and the stack relative to one another so that each sheet of the stack is pierced by the piercing members.

46. The method of claim 45 wherein the driving of the piercing members relative to the stack is such that the edge of the stack is linear subsequent to the conditioning and wherein stack dimensions prior and subsequent to the conditioning are substantially unchanged.

47. A sheet conditioned in accordance with claim 46.

48. Apparatus for conditioning an edge of a stack of sheets to be bound comprising:

a stack clamping mechanism configured to secure the stack of sheets, with a region of the sheets near the edge lying within individual parallel sheet planes, with the edge of the stack being substantially disposed in a single edge plane generally normal to the parallel sheet planes;

a piercing member including a plurality of piercing elements, with each of the piercing elements having a cutting surface disposed along a common cutting plane, with said piercing member being configured to produce a reciprocating action along a reciprocating axis, with the reciprocating axis being substantially parallel to the sheet planes;

a positioning mechanism configured to control a relative movement of the stack clamping mechanism and the piercing member; and a drive mechanism configured to periodically drive the piercing member so that the piercing elements move along the reciprocating axis into the edge of the stack substantially exclusively through the edge plane and away from the edge of the stack substantially exclusively through the edge plane.

49. The apparatus of claim 48 wherein the cutting plane is disposed at an angle with respect to the sheet planes which is less than 10 degrees.

50. The apparatus of claim 48 further including a plurality of the piercing members, with each of the piercing members including piercing elements having a cutting surface disposed along a respective common cutting plane.

51. The apparatus of claim 50 wherein the respective common cutting planes of the plurality of piercing members are disposed in a common plane.

52. The apparatus of claim 48 further including a plurality of the piercing members, with the drive mechanism being further configured to sequentially drive at least some of each of the piercing members into the stack at differing times so that one of the piercing members engages the stack at a time that differs from that of another one of the piercing members.

53. A method of conditioning an edge of a stack of sheets to be bound, with a number of sheet in the stack determining a thickness of the stack, said method comprising:

providing a piercing member;

supporting the stack so that a compression force is applied to the stack in a region near the edge of the stack; and moving the piercing member and the stack relative to one another; and during the moving, periodically reciprocating the piercing member so that the piercing member is driven into the edge of the stack and away from the stack, with a number of reciprocations being dependent upon the thickness of the stack.

54. The method of claim 53 where the number of times is such that each sheet of the stack is pierced at least one during the driving.

55. The method of claim 54 wherein a plurality of the piercing members is provided and wherein the periodically reciprocating includes driving at least some of the piercing members into and away from the stack at differing points in time so that one of the piercing members engages the stack at a time which differs from a time that another one of the piercing members engages the stack.

56. Apparatus of conditioning an edge of a stack of a plurality of sheets to be bound comprising:

a stack clamping mechanism configured to secure the stack of sheets so that the stack edge falls within an edge plane;

at least one relatively rigid piercing member;

a drive mechanism configured to drive the at least one piercing member into the stack edge so as to pierce the stack and to withdraw the at least one of the piercing member from the stack edge substantially exclusively through the edge plane; and a positioning mechanism configured to control relative movement of the stack clamping mechanism and the at least one piercing member so that each sheet of the stack is engaged at least once by the at least one piercing member.

57. The apparatus of claim 56 further including a plurality of the rigid piercing members and wherein the drive mechanism if further configured to drive the piercing members into the stack edge and to withdraw the piercing members from the stack edge substantially exclusively through the edge plane, with at least two of the rigid piercing members engaging the stack edge at differing points in time.

58. A method of conditioning an edge of a stack of sheets to be bound, said method comprising:

supporting the stack of sheets by applying a compression force to at least the edge of the stack, with the edge of the stack being disposed in an edge plane; and repeatedly piercing the edge of the stack with a relatively rigid piercing member so that each sheet of the stack is contacted, with the piercing including contacting the edge of the stack substantially exclusively through the edge plane and including withdrawing from the edge of the stack substantially exclusively through the edge plane, with the edge of the stack being linear prior to and after the conditioning and with stack dimensions being substantially constant before and after the conditioning.

59. A sheet conditioned in accordance with the method of claim 58.

* * * * *